US008490636B2

(12) United States Patent
Yang

(10) Patent No.: US 8,490,636 B2
(45) Date of Patent: Jul. 23, 2013

(54) ULTRASONIC CLEANING DEVICE

(76) Inventor: Wender Yang, Xindian (TW)

( * ) Notice: Subject to any disclaimer, the term of this patent is extended or adjusted under 35 U.S.C. 154(b) by 496 days.

(21) Appl. No.: 12/793,117

(22) Filed: Jun. 3, 2010

(65) Prior Publication Data

US 2010/0313920 A1 Dec. 16, 2010

(30) Foreign Application Priority Data

Jun. 11, 2009 (TW) ..... 98210350 U

(51) Int. Cl.
*B08B 3/12* (2006.01)

(52) U.S. Cl.
USPC ..... 134/184

(58) Field of Classification Search
CPC ..... B08B 3/12; A61L 2/025; G10K 11/004; G10K 11/006
USPC ..... 134/184; 422/127–128
See application file for complete search history.

(56) References Cited

U.S. PATENT DOCUMENTS 4,114,194 A * 9/1978 Walter ..... 366/111
4,691,724 A * 9/1987 Garcia et al. ..... 134/169 R
5,167,626 A * 12/1992 Casper et al. ..... 604/891.1
5,840,126 A * 11/1998 Yoshida et al. ..... 134/1
6,543,701 B1 * 4/2003 Ho ..... 239/102.1
6,997,206 B1 * 2/2006 Klockseth et al. ..... 137/102
2007/0193608 A1 * 8/2007 Kim ..... 134/56 D
2007/0240744 A1 * 10/2007 Schlief et al. ..... 134/104.4

OTHER PUBLICATIONS

U.S. Appl. No. 12/793,117—Applicant's Reply Fax.*

* cited by examiner

*Primary Examiner* — Michael Kornakov
*Assistant Examiner* — Marc Lorenzi
(74) *Attorney, Agent, or Firm* — Wang Law Firm, Inc.; Li K. Wang; Stephen Hsu

(57) ABSTRACT

An ultrasonic cleaning device includes a drain connecting member adapted to be engaged with a drain hole of a sink, and having a valve seat, a valve member having a valve portion angularly movable relative to the valve seat between an opened position to be disengaged from the valve seat to thereby allow for liquid communication between a reservoir of the sink and the drain hole, and a closed position to be engaged with the valve seat for interrupt the liquid communication, and an ultrasonic generating unit disposed in the valve member for exerting ultrasonic vibration on liquid within the reservoir.

15 Claims, 7 Drawing Sheets

ULTRASONIC CLEANING DEVICE

CROSS-REFERENCE TO RELATED APPLICATION

This application claims priority of Taiwanese Application No. 098210350, filed on Jun. 11, 2009, the disclosure of which is herein incorporated by reference.

BACKGROUND OF THE INVENTION

1. Field of the Invention

This invention relates to an ultrasonic cleaning device, more particularly to an ultrasonic cleaning device adapted to be used in a domestic sink.

2. Description of the Related Art

A conventional ultrasonic cleaner generally has a container for accommodating an object to be cleaned, and an ultrasonic generating transducer disposed in the container. An appropriate amount of liquid is filled in the container, and the ultrasonic generating transducer produces ultrasonic waves in the liquid to induce cavitation bubbles that act on contaminants adhered to the object for cleaning the object. Such an ultrasonic cleaner is often employed for cleaning of small objects, such as jewelry, lenses, coins, dental and surgical instruments, industrial parts and electronic equipment. However, it is desired to use an ultrasonic cleaning device with a domestic sink, such as a kitchen sink, such that an object can be washed in the sink. Moreover, it is also desired to perform drainage during a cleaning operation. In the conventional ultrasonic cleaner, however, it is impossible to use with a domestic sink and perform drainage during a cleaning operation.

SUMMARY OF THE INVENTION

An object of the present invention is to provide an ultrasonic cleaning device which is adapted to be used in a domestic sink and which can perform drainage during a cleaning operation.

According to an aspect of this invention, the ultrasonic cleaning device includes a drain connecting member, a valve member, and an ultrasonic generating unit. The drain connecting member includes a lower tubular portion adapted to be inserted into a drain hole of a sink, and an upper tubular portion having at least one valve seat to be disposed downstream of a reservoir of the sink and upstream of the drain hole. The valve member has at least one valve portion which is angularly movable relative to the upper tubular portion between an opened position to be disengaged from the valve seat so as to permit liquid communication between the reservoir and the drain hole, and a closed position to be engaged with the valve seat so as to interrupt the liquid communication, and a barrel wall which is disposed above the valve portion and which defines an accommodation chamber therein. The ultrasonic generating unit is disposed in the accommodation chamber for exerting ultrasonic vibration on liquid within the reservoir.

According to another aspect of this invention, the ultrasonic cleaning tank assembly includes a tank and the ultrasonic cleaning device. The tank is adapted to be disposed in the reservoir of the sink, and has a receiving chamber, a base wall defining a bottom end of the receiving chamber, an outlet port disposed in the base wall, and a plurality of feet which are disposed on and under the base wall and which are adapted for suspending the base wall from the bottom wall of the sink.

The ultrasonic cleaning device can be mounted within the sink. By turning the valve member relative to the upper tubular portion to move the valve portion to the opened position, the drainage can be performed during the cleaning operation.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
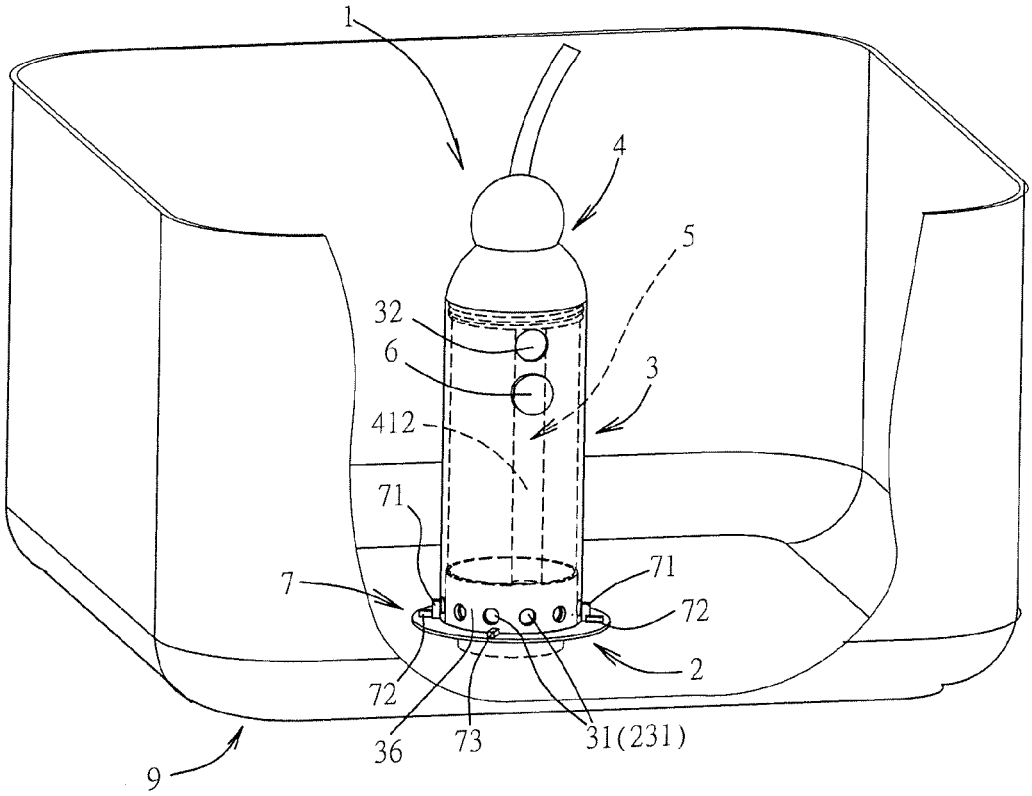
FIG. 1 is a perspective view of the first preferred embodiment of an ultrasonic cleaning device according to this invention when mounted in a domestic sink.

Before the present invention is described in greater detail, it should be noted that same reference numerals have been used to denote like elements throughout the specification.

Figure 2:
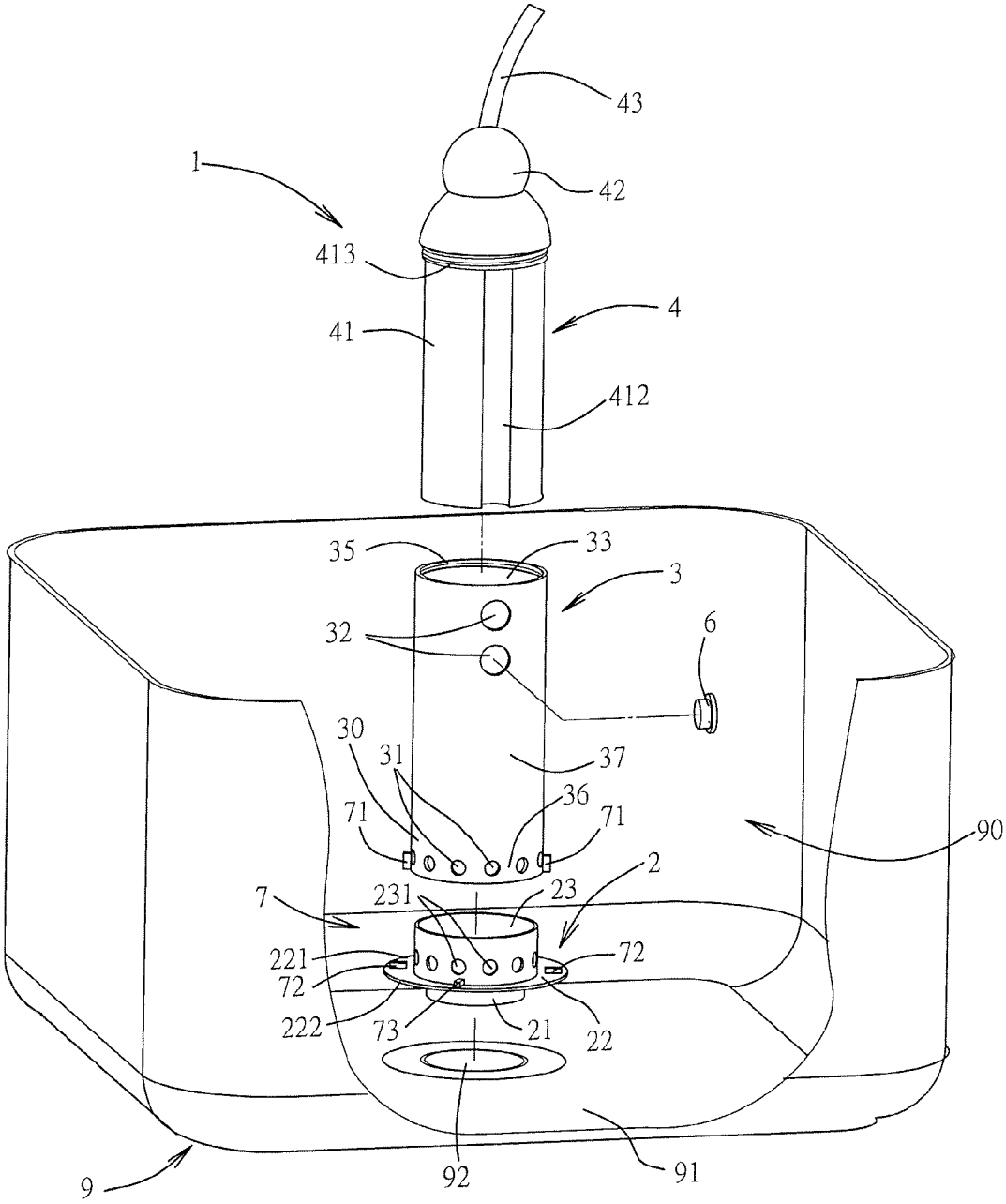
FIG. 2 is an exploded perspective view of the first preferred embodiment.

Referring to FIGS. 1 and 2, the first preferred embodiment of an ultrasonic cleaning device 1 according to the present invention is adapted to be mounted within a sink 9, such as a kitchen sink. The tank 9 has a reservoir 90 and a drain hole 92 disposed at a bottom wall 91 of the reservoir 90. The ultrasonic cleaning device 1 of this embodiment comprises a drain connecting member 2, a valve member 3, an ultrasonic generating unit 4, and a stopping unit 7.

The drain connecting member 2 includes a lower tubular portion 21 configured to be inserted into the drain hole 92, an upper tubular portion 23 which is disposed above the lower tubular portion 21 and which has a plurality of valve seats 231 adapted to be disposed downstream of the reservoir 90 and upstream of the drain hole 92, and an annular flange 22 which is disposed between the upper and lower tubular portions 23,21 and which has an upper surface 221 and a lower surface 222 that abuts against the bottom wall 91 of the reservoir 90. In this embodiment, the upper tubular portion 23 has a plurality of first holes 231 which are angularly spaced apart from one another and which serve as the valve seats 231, respectively.

Figure 3:
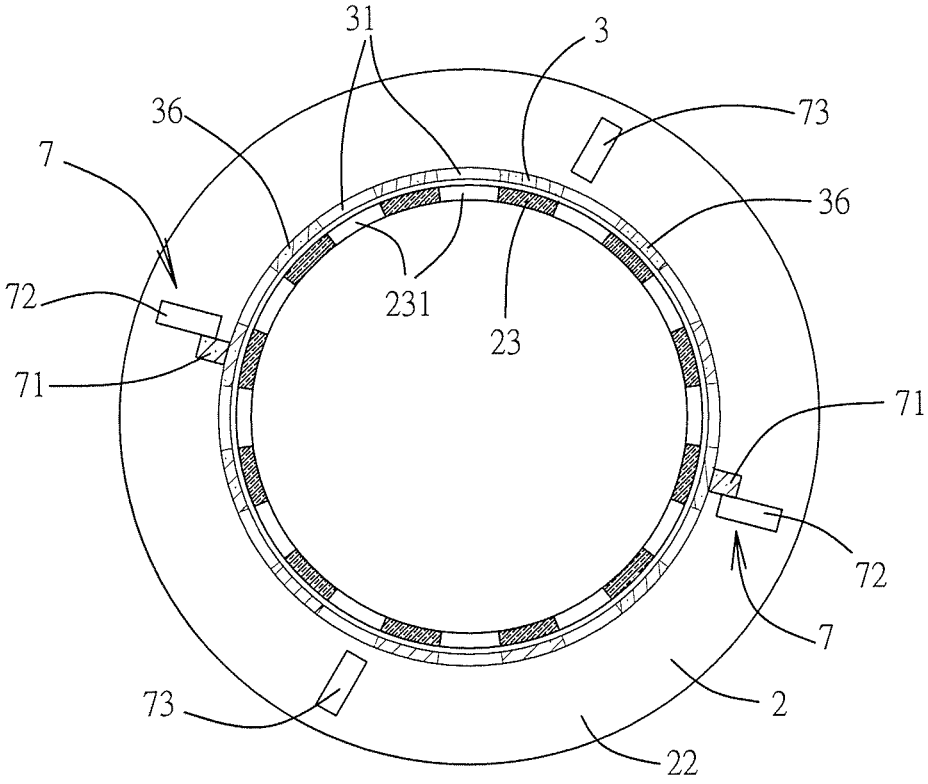
FIG. 3 is a sectional view of the first preferred embodiment, showing that a valve member is disposed at an opened position.
Figure 4:
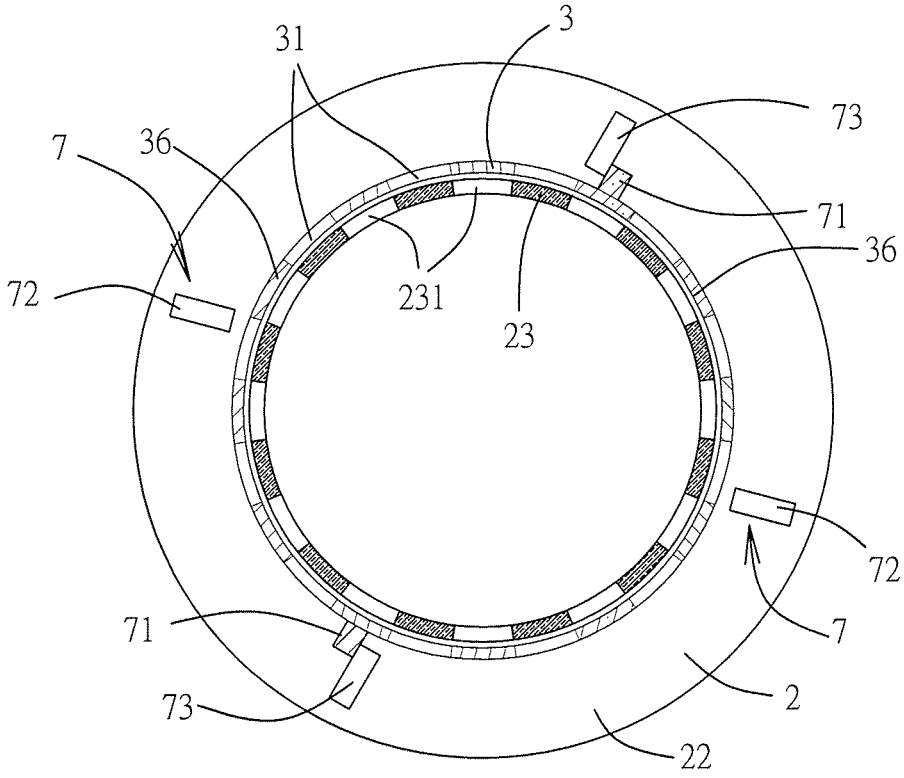
FIG. 4 is a sectional view of the first preferred embodiment, showing that the valve member is disposed at a closed position.

The valve member 3 has a surrounding wall 30 which is sleeved on the upper tubular portion 23 and which abuts against the upper surface 221 of the annular flange 22. The surrounding wall 30 has a plurality of second holes 31 angularly spaced apart from one another such that any two adjacent ones of the second holes 31 define a valve portion 36 therebetween. The surrounding wall 30 is turnable relative to the upper tubular portion 23 to move each of the valve portions 36 between an opened position, as shown in FIG. 3, where the valve portions 36 are disengaged respectively from the valve seats 231, i.e., the second holes 31 are aligned respectively with the first holes 231 to permit liquid communication between the reservoir 90 and the drain hole 92, and a closed position, as shown in FIG. 4, where the valve portions 36 are engaged respectively with the valve seats 231, i.e., the second holes 31 are misaligned respectively from the first holes 231 to interrupt the liquid communication between the reservoir 90 and the drain hole 92. The valve member 3 further has a barrel wall 37 which extends upwardly from the surrounding wall 30 and which defines an accommodation chamber 33 therein. Two overflow holes 32 are formed in the barrel wall 37, and are arranged one above the other to fluidly communicate the reservoir 90 with the accommodation chamber 33.

The ultrasonic generating unit 4 includes a cylindrical ultrasonic vibrating member 41 which is configured to be inserted into the accommodation chamber 33 of the valve member 3 for exerting ultrasonic vibration on liquid within the reservoir 90 and which has a drain passage 412 that extends lengthwise to communicate the overflow holes 32 with the drain hole 92. The overflow liquid within the reservoir 90 can be discharged through the overflow holes 32 and the drain passage 412. If desired, a plug 6 can be employed to plug one of the overflow holes 32 to adjust overflow level of liquid in the reservoir 90.

In this embodiment, the ultrasonic vibrating member 41 has an externally threaded portion 413 which is engaged with an internally threaded portion 35 of the barrel wall 37 to secure the ultrasonic generating unit 4 to the valve member 3. The ultrasonic generating unit 4 further includes a control member 42 for controlling the ultrasonic vibrating member 41, and a power cord 43 connected to a power supply.

The stopping unit 7 includes first and second blocks 72, 73 disposed on the upper surface 221 and angularly spaced apart from each other, and a third block 71 disposed on the surrounding wall 30 and co-rotatable with the valve member 3 to abut against the first block 72 when each of the valve portions 36 is in the opened position (see FIG. 3), and to abut against the second block 73 when each of the valve portions 36 is in the closed position (see FIG. 4). Thus, the stopping unit 7 can limit angular movement of each of the valve portions 36 between the opened and closed positions.

According to this embodiment, the ultrasonic cleaning device 1 can be used with a domestic sink 9. Moreover, by virtue of a control circuit unit (not shown) in the control member 42, two cleaning modes can be performed by the ultrasonic cleaning device 1. One mode includes the steps of: filling water into the reservoir 90 to a predetermined amount, activating the ultrasonic vibrating member 41 for cleaning an object in the reservoir 90, and draining the water from the reservoir 90. In this mode, each of the valve portions 36 is placed in the closed position before the cleaning operation is completed, and in the opened position after the cleaning operation is completed. The other mode includes the steps of: filling water into the reservoir 90 to a predetermined amount, activating the ultrasonic vibrating member 41 and moving the valve portions 36 to the opened positions while supplying water into the reservoir 90, and draining the water from the reservoir 90. In this mode, the water and contaminants removed from the cleaned object may be discharged during the cleaning operation.

Figure 5:
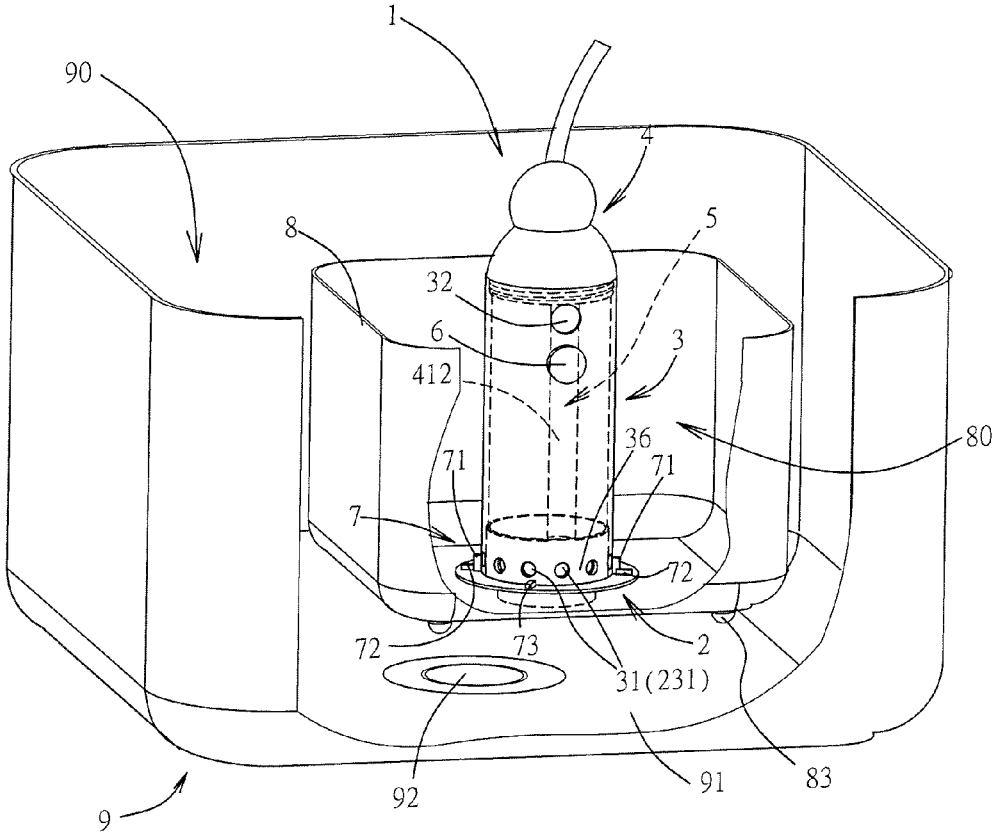
FIG. 5 is a cutaway perspective view of the second preferred embodiment of an ultrasonic cleaning device according to this invention when mounted in a domestic sink.
Figure 6:
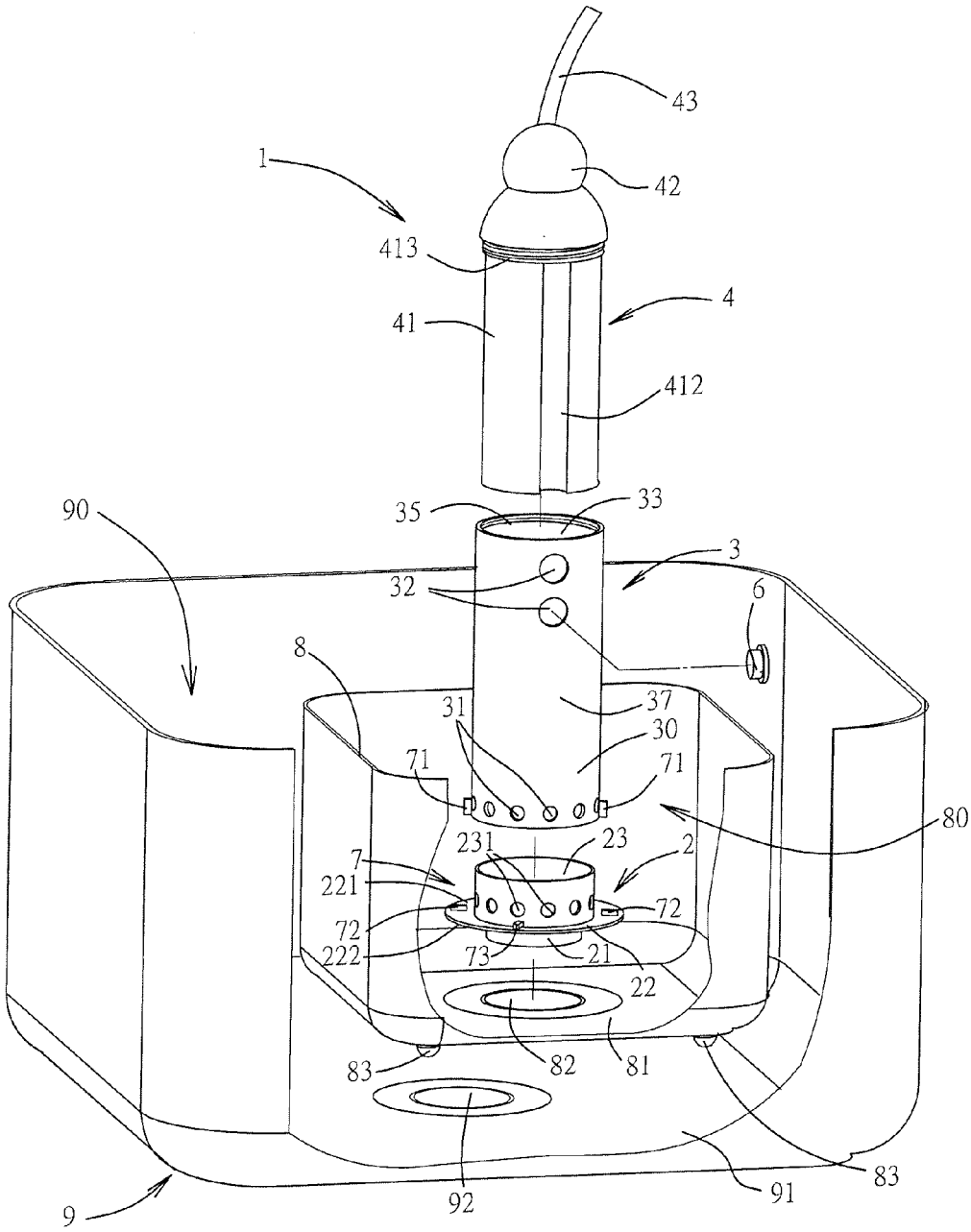
FIG. 6 is an exploded cutaway perspective view of the second preferred embodiment.
Figure 7:
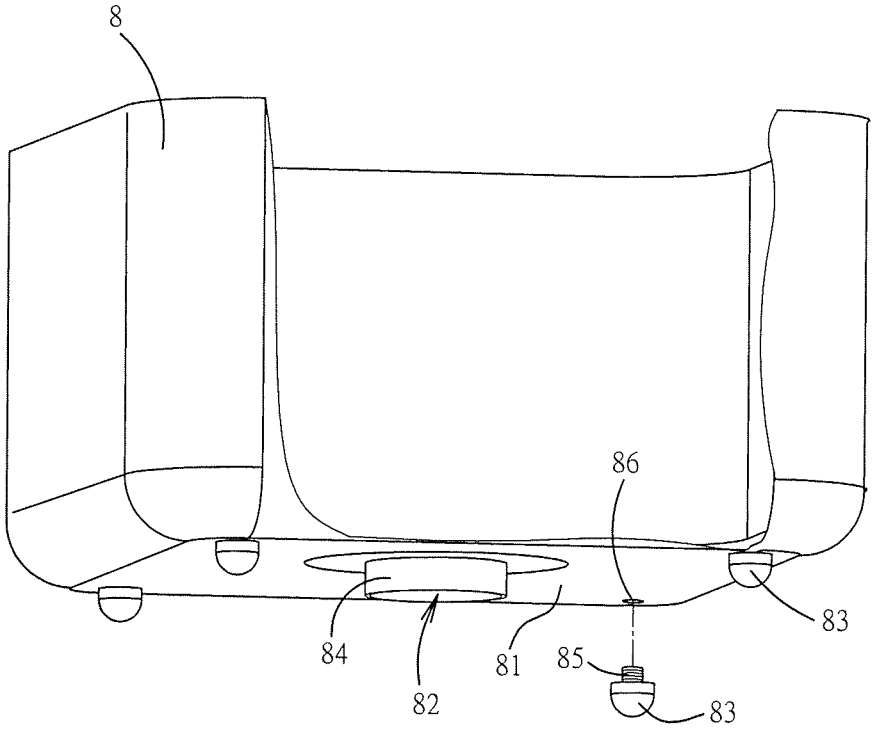
FIG. 7 is a cutaway perspective view of a tank of the second preferred embodiment.

Referring to FIGS. 5 to 7, the second preferred embodiment of the ultrasonic cleaning device 1 is different from the first preferred embodiment in that it further includes a tank 8 adapted to be mounted within a sink 9.

The tank 8 has a receiving chamber 80, a base wall 81 defining a bottom end of the receiving chamber 80, an outlet port 82 disposed in the base wall 81, a plurality of feet 83 disposed on and under the base wall 81 for suspending the base wall 81 from the bottom wall 91, and a supporting tube 84 extending downwardly from the base wall 81 and cooperating with the feet 83 for providing a stable support to the remaining portion of the tank 8 when the tank 8 is mounted in the sink 9. Each of the feet 83 has a threaded portion 85 engaged with a screw hole 86 in the base wall 81 such that the height of the foot 83 is adjustable.

In this embodiment, the lower tubular portion 21 of the drain connecting member 2 of the ultrasonic cleaning device 1 is inserted into the outlet port 82 instead of the drain hole 92, and the annular flange 22 abuts against the base wall 81 such that the first holes 231 (the valve seats 231) are disposed downstream of the receiving chamber 80 and upstream of the outlet port 82. The ultrasonic vibrating member 41 of the ultrasonic generating unit 4 is adapted for exerting ultrasonic vibration on liquid within the receiving chamber 80. The overflow holes 32 in the valve member 3 are disposed to fluidly communicate the receiving chamber 80 with the accommodation chamber 33. The drain passage 412 of the ultrasonic vibrating member 41 is disposed to communicate the overflow holes 32 with the outlet port 82. A plug 6 may be employed to plug one of the overflow holes 32 to adjust overflow level of liquid in the receiving chamber 80.

According to this embodiment, the ultrasonic cleaning device 1 is adapted to be mounted in the sink 9 for cleaning an object placed within the receiving chamber 80. The space outside the tank 8 and inside the sink 9 is available for other uses.

As illustrated, by virtue of the lower tubular portion 21 inserted into the drain hole 92 of the sink 9 or the outlet port 82 of the tank 8, the ultrasonic cleaning device 1 can be mounted within the sink 9. By turning of the valve member 3 relative to the upper tubular portion 23 to move each of the valve portions 36 to the opened position, the drainage can be performed during the cleaning operation.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An ultrasonic cleaning device adapted to be mounted within a sink having a reservoir with a bottom wall and a drain hole disposed on the bottom wall, the ultrasonic cleaning device comprising:

a drain connecting member including a lower tubular portion adapted to be removably inserted into the drain hole, and an upper tubular portion which is disposed above the lower tubular portion, the upper tubular portion having a plurality of spaced holes which are disposed downstream of the reservoir and upstream of the drain hole;

a valve member located above the drain hole comprising a barrel wall and a valve portion, wherein the valve portion is located at a bottom end of the barrel wall and has a plurality of spaced holes, wherein the valve portion is sleeved on the upper tubular portion so as to be rotatably movable relative to the upper tubular portion between opened and closed positions, the opened position being defined as when the holes of the valve portion overlap in alignment with the holes of the upper tubular portion and permit liquid communication between the reservoir and the drain hole, and the closed position being defined as when the holes of the valve portion do not overlap in alignment with the holes of the upper tubular portion and do not permit liquid communication between the reservoir and the drain hole;

an accommodation chamber defined by the barrel wall and located above the valve portion; and an ultrasonic generating unit disposed in the accommodation chamber and adapted for exerting ultrasonic vibration on liquid within the reservoir.

2. The ultrasonic cleaning device according to claim 1, wherein the barrel wall has at least one overflow hole disposed to fluidly communicate the reservoir with the accommodation chamber, the ultrasonic generating unit including a cylindrical ultrasonic vibrating member which is configured to be inserted into the accommodation chamber, and which has a drain passage that is adapted to extend lengthwise to communicate the overflow hole with the drain hole.

3. The ultrasonic cleaning device according to claim 2, wherein the barrel wall has two overflow holes, the ultrasonic cleaning device further comprising a plug which is disposed to plug only one of the overflow holes to adjust overflow level of liquid in the reservoir.

4. The ultrasonic cleaning device according to claim 1, wherein the drain connecting member includes an annular flange which is disposed between the upper and lower tubular portions and which has an upper surface allowing for abutment of the valve member thereagainst, and a lower surface adapted to abut against the bottom wall of the reservoir.

5. The ultrasonic cleaning device according to claim 4, further comprising a stopping unit which is disposed between the valve member and the upper surface to limit angular movement of the valve portion between the opened and closed positions.

6. The ultrasonic cleaning device according to claim 5, wherein the stopping unit includes first and second blocks disposed on the upper surface and angularly spaced apart from each other, and a third block disposed on the valve member and movable to abut against the first block when the valve portion is in the opened position, and to abut against the second block when the valve portion is in the closed position.

7. The ultrasonic cleaning device according to claim 1, wherein the ultrasonic generating unit has an externally threaded portion, and the barrel wall has an internally threaded portion engaging the externally threaded portion of the ultrasonic generating unit.

8. An ultrasonic cleaning device adapted to be mounted within a sink having a reservoir with a bottom wall and a drain hole disposed at the bottom wall of the reservoir, the ultrasonic cleaning device comprising:

a tank adapted to be disposed in the reservoir, the tank having a receiving chamber, a base wall defining a bottom end of the receiving chamber, an outlet port which is disposed in the base wall, and a plurality of feet which are disposed on and under the base wall and which are adapted for suspending the base wall from the bottom wall;

a drain connecting member including a lower tubular portion adapted to be removably inserted into the outlet port, and an upper tubular portion which is disposed above the lower tubular portion, the upper tubular portion having a plurality of spaced holes which are disposed downstream of the receiving chamber and upstream of the outlet port;

a valve member located above the outlet port comprising a barrel wall and a valve portion, wherein the valve portion is located at a bottom end of the barrel wall and has a plurality of spaced holes, wherein the valve portion is sleeved on the upper tubular portion so as to be rotatably movable relative to the upper tubular portion between opened and closed positions, the opened position being defined as when the holes of the valve portion overlap in alignment with the holes of the upper tubular portion and permit liquid communication between the receiving chamber and the outlet port, and the closed position being defined as when the holes of the valve portion do not overlap in alignment with the holes of the upper tubular portion and do not permit liquid communication between the receiving chamber and the outlet port; and an accommodation chamber defined by the barrel wall and located above the valve portion; and an ultrasonic generating unit disposed in the accommodation chamber and adapted for exerting ultrasonic vibration on liquid within the receiving chamber.

9. The ultrasonic cleaning device according to claim 8, wherein the barrel wall has at least one overflow hole disposed to fluidly communicate the receiving chamber with the accommodation chamber, the ultrasonic generating unit including a cylindrical ultrasonic vibrating member which is configured to be inserted into the accommodation chamber, and which has a drain passage that extends lengthwise to communicate the overflow hole with the outlet port.

10. The ultrasonic cleaning device according to claim 9, wherein the barrel wall has two overflow holes, the ultrasonic cleaning device further comprising a plug which is disposed to plug only one overflow hole to adjust overflow level of liquid in the receiving chamber.

11. The ultrasonic cleaning device according to claim 8, wherein the drain connecting member includes an annular flange which is disposed between the upper and lower tubular portions and which has an upper surface allowing for abutment of the valve member thereagainst, and a lower surface abutting against the base wall of the tank.

12. The ultrasonic cleaning device according to claim 11, further comprising a stopping unit which is disposed between the valve member and the upper surface to limit angular movement of the valve portion between the opened and closed positions.

13. The ultrasonic cleaning device according to claim 12, wherein the stopping unit includes first and second blocks disposed on the upper surface and angularly spaced apart from each other, and a third block disposed on the valve member and movable to abut against the first block when the valve portion is in the opened position, and to abut against the second block when the valve portion is in the closed position.

14. The ultrasonic cleaning device according to claim 8, wherein the ultrasonic generating unit has an externally threaded portion, and the barrel wall has an internally threaded portion engaging the externally threaded portion of the ultrasonic generating unit.

15. The ultrasonic cleaning device according to claim 8, wherein each of the feet is configured to have an adjustable height.

* * * * *